United States Patent [19]

Smith et al.

[11] 4,104,172

[45] Aug. 1, 1978

[54] DURABLE FLAME RETARDANT FINISHES FOR TEXTILE MATERIALS

[75] Inventors: Ray E. Smith; James A. Albright, both of Ann Arbor, Mich.

[73] Assignee: Velsicol Chemical Corporation, Chicago, Ill.

[21] Appl. No.: 660,500

[22] Filed: Feb. 23, 1976

[51] Int. Cl.[2] ..... C09K 3/28

[52] U.S. Cl. ..... 252/8.1; 8/116 P; 427/341; 427/342; 427/390 D

[58] Field of Search ..... 252/8.1, 312; 427/390 D, 341, 342; 8/116 P; 260/963

[56] References Cited

U.S. PATENT DOCUMENTS

| | | | |
|---|---|---|---|
| 3,004,056 | 10/1961 | Nunn et al. | 252/DIG. 1 |
| 3,310,419 | 3/1967 | Wagner | 427/390 D |
| 3,324,205 | 6/1967 | Carpenter et al. | 252/8.1 |
| 3,645,936 | 2/1972 | Gardner | 8/116 P |
| 3,784,356 | 1/1974 | Wagner | 427/390 D |
| 3,830,886 | 8/1974 | Davis et al. | 260/963 |
| 3,856,535 | 12/1974 | Ferguson | 252/8.1 |
| 3,888,779 | 6/1975 | Chao | 252/8.1 |
| 3,932,502 | 1/1976 | Nachbor et al. | 252/8.1 |
| 3,936,585 | 2/1976 | Leblanc et al. | 252/8.1 |

*Primary Examiner*—Benjamin R. Padgett
*Assistant Examiner*—Deborah L. Kyle
*Attorney, Agent, or Firm*—Robert M. Phipps; Howard J. Greenwald

[57] ABSTRACT

Novel flame retardant finishes comprising a water soluble quaternary phosphonium salt, a water soluble organic nitrogen containing compound, a haloalkyl phosphate of the formula

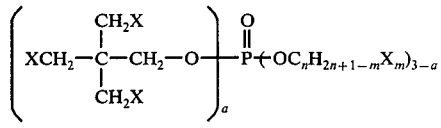

wherein each X is independently selected from chlorine, bromine, and hydrogen, wherein *a* is an integer from 1 to 2, wherein *n* is an integer from 1 to 8, wherein *m* is an integer from 0 to *n*, provided that when *n* is 1, *m* is 0, and mixtures of said haloalkyl phosphates, an emulsifiying agent which is capable of passing the following three tests: (1) Solubility (Compatability) Test: said emulsifying agent (20 parts by weight) must be soluble in 80 parts by weight of said phosphate ester at less than or equal to 80° C.; (2) Shelf Life Test: a blend of said emulsifying agent and said phosphate ester prepared as in the Solubility Test must remain in one clear homogeneous phase at 22° C. for at least 1 hour; (3) Finish Formulation Test: a flame retardant finish within the scope of this invention is prepared and must remain in one homogeneous phase for a minimum of 1 hour at 20° C. These flame retardant finishes are excellent for flame retarding textile materials including polyester/-cotton blend fabrics.

50 Claims, No Drawings

DURABLE FLAME RETARDANT FINISHES FOR TEXTILE MATERIALS

BACKGROUND OF THE INVENTION

1. Field of the Invention

This invention pertains to finishes containing agents specifically designed to render the materials treated therewith flame retardant.

2. Description of the Prior Art

Recent years have witnessed a great interest in and a growing demand for flame retardant textiles and fabrics. Due to its substantial portion of the textile market, one such fabric which has engrossed the attention of many is polyester/cotton blends. The market dominance of these blends is due in part to consumers' demand for minimum care products of satisfactory overall performance and wear-life. However, polyester/cotton blend fabrics have persisted in evading researchers in their attempts to successfully impart durable flame retardancy to them without a loss of or significant dimunition in their physical properties. For example, although satisfactory flame retardants are available for 100% cotton fabrics and 100% polyester fabrics, satisfactory flame retardants have not hitherto been available for polyester/cotton blend fabrics. This phenomena is in part due to the fact that "(c)hemical systems which have been developed for flame retardant finishing of 100% cellulosics are not necessarily effective in imparting self-extinguishing behavior to fabrics containing cellulosic and polyester fibers." G. C. Tesoro, "Status and Prospects for Flame Resistant Polyester/Cellulose Blend Fabrics," 39, National Technical Information Service, Springfield, VA, 1973. Also, "(t)here are significant differences in the extent to which organophosphorus systems found to be effective flame retardants for cellulose maintain this effectiveness in the presence of polyester." Ibid., 39. Additionally, "(t)he synergistic contribution of nitrogen to flame retardant effectiveness of phosphorus (which has been documented for 100% cellulose substrates) has not been demonstrated as being significant in the presence of polyester." Ibid., 39.

A news release by the Textile Research Institute, Princeton, New Jersey for release not before March 2, 1975, entitled "TRI Studies on Flame Retardancy of Polyester/Cotton Blends," reports that "one of the major problems with polyester/cotton blends is that the flammability behavior of these blends cannot be directly predicted from the behavior of the components. For example, the study at TRI has revealed that such blends ignite sooner, burn faster, generate heat faster, and thermally decompose faster than might be expected on the basis of the behavior of cotton and of polyester alone. The data indicate that there are important interactions between the cotton and the polyester when these two fibers are burned in combination . . . . (F)or example, . . . mixtures of polyester and cotton evolve more volatile hydrocarbons, such as ethylene and acetylene, than are evolved by cotton and by polyester when these fibers are pyrolyzed alone under comparable conditions. This is one of the reasons that the blends are difficult to flame retard." This report concludes that "(a) blend becomes a new chemical species with its own unique flammability properties."

In "Progress in the Development of Flame-Resistant Polyester-Cotton Blends", Proceedings of the 1974 Symposium on Textile Flammability, 116, LeBlanc Research Corporation, 5454 Post Road, East Greenwich, Rhode Island, 1974, W. A. Reeves et al. state that "(s)atisfactory flame retardants are available for cotton fabrics and polyester fabrics but are not available for polyester/cotton blend fabrics". Although "(s)ome flame retardants for cellulosic fibers are equally effective on polyester and vice versa if one is only interested in flame resistance", "(p)roperties such as aesthetics and durability to laundering are often lacking in treated fabrics."

Vladimir Mischutin in an article entitled "A New FR System for Synthetic/Cellulosic Blends", *Textile Chemist and Colorist,* Vol. 7, No. 3, pp. 40/2 (March, 1975) reports that "(s)ince the passage in 1967 of the amendment to the 1953 Flammable Fabrics Act, textile researchers have sought to develop technology to produce flame retardant fabrics. This had resulted in the development of various commercial processes to render 100% cotton fabrics flame retardant. In addition, a FR process involving emulsion containing tris(dibromopropyl)phosphate was developed for 100% polyester fabrics. This technology, together with the use of inherently flame retardant fibers, was sufficient to satisfy the requirements for sleepwear in sizes 0–6X; however, the intent of the law was not limited to the sleepwear worn by children. Additional technology was needed to satisfy growing demand for flame retardant fabrics.

"Initially, it appeared a simple matter to combine the available techniques for cellulosic fabrics and for polyester goods and obtain flame retardant blends, which are by far the biggest volume used for apparel. Those that tried this approach were-unpleasantly surprised. Existing technology did not answer the requirement on blends, and new techniques were needed . . . .

"Among brominated flame retardants the material most commonly used is tris(2,3-dibromopropyl)phosphate. This material possesses good heat and hydrolytic stabilities; it is highly insoluble in water; it is colorless and nontoxic. However, tris(dibromopropyl)phosphate is a secondary plasticizer and has a tendency to impact (sic) a tacky hand to the substrates to which it is applied. In addition, due to its lack of reactive groups, it is difficult to attach permanently to both synthetic and cellulosic fibers. In view of this, all efforts to obtain a flame retardant system for polyester/cellulosic fabric which would comply with DOC FF 3-71 were completely unsuccessful."

Similarly, Dr. W. F. Battinger states in "The Application of a Phosphonium Salt Flame Retardant to Polyester-Cotton Blend Fabrics," Book of Papers, 1974 National Technical Conference, (Oct. 9 to the 11, 1974, New Orleans, Louisianna), 467, American Association of Textile Chemists and Colorists, P.O. Box 12215, Research Triangle Park, N.C. 27709, 1974, that "the treatment of polyester/cotton blends presents a difficult problem in flammability protection because of the vast differences in physical properties and burning characteristics between two fibers". In this paper, Dr. Battinger reports the results of his research with combination applications of phosphonium salts, urea and tris(2,3-dibromopropyl)phosphate in the following words:

"The lowered response of LOI to added phosphorus for a blend fabric compared to 100% cotton is indicative of major differences in flammability protective mechanisms for the two fibers. Since the phosphonium salt studied here is only marginally capable of protecting the blend utilizing phosphorus and nitrogen alone, consideration of phosphorus and bromine in combination is a viable alternative. Tris-2,3-dibromopropyl phosphate was chosen as a bromine source because of its ready availability and known activity in improving 100% polyester fabric flammability characteristics. Since the LOI/%P responses for the 50/50 and 65/35 polyester/cotton blend were similar (with respect to the same add-on levels of tetrakis(hydroxymethyl)phosphonium oxalate), the 65/35 blend is used to illustrate the combination effect . . . . The dibromopropyl phosphate in perchloroethylene was padded onto the fabric, followed by drying and curing 1.5 minutes at 400° F. to simulate Thermosoling. The process wash consisted of one Kenmore wash with detergent . . . . (F)ixation as judged by durability of this wash was quite good. Maximum OI values of 0.24 were obtained at about 10% Br applied. From related studies on 100% cotton for this material showing lesser durability, it can be inferred that most of the bromine containing material is associated with the polyester component of the blend. (Note: This is the converse of what applied for the phosphonium salt previously.)

"The identical fabrics used to generate these curves were then subjected to an aqueous application of tetrakis-hydroxymethyl phosphonium oxalate in the same fashion as the blends were treated previously. Applications were set to provide 2% phosphorus. This value was chosen to theoretically yield an increase of 0.05 OI unit. The consequences of the topical application . . . . compared to theoretical calculations show excellent agreement indicating the additivity properties of LOI data. Somewhat surprisingly, however, while LOI values of 0.29 were attained, no samples passes the DOC vertical test.

"The anomaly of materials with LOI's of 25 passing the vertical test when phosphonium compounds alone were employed, and LOI's of 29 failing when a supplemental bromine compound is used is reconcilable in part by consideration of the action of the materials as flame retardants and the geometry of the test employed. The phosphonium compound is a "condensed phase" acting flame retardant; no evidence is available indicating its action in vapor phase chemistry, nor is it a melt-decomposition temperature reducer for polyester. Dibromopropyl phosphate, on the other hand, is known to significantly lower the melt decomposition temperature of polyester fiber. For 100% polyester fabrics, flame retardancy is enhanced by this shrinking and dripping away. In a blend with cellulose, however, this cannot occur because of the support provided by the cotton, thus the geometry of burning comes into play. In the LOI test the sample is burned vertically downward; as polyester melts, it flows from the flame front, thus depleting fuel supply. In the DOC test burning is vertically upward and the reverse effect, fuel enrichment, occurs. The net results of these effects logically seems exactly what was observed in these experiments—high LOI's but failures in DOC testing."

Concern has begun to mount as to whether polyester/cotton blend fabrics will lose their share of the textile market because of present, pending, and contemplated federal and state legislation mandating nonflammability standards for, inter alia, fabrics and textiles. A clear example of this concern can be seen in the following excerpt wherein the authors argue for the lowering of the flammability standard for polyester/-cotton blend fabrics:

"The types of fabric used in largest volume for apparel are polyester/cotton blends. At present there is no fully commercial method of producing polyester/cotton fabric to meet FF 3-71, primarily because of problems with the hand of the treated fabrics. Obviously, if there is any extension of standards requiring self-extinguishing properties beyond the present small end-uses (children's sleepwear), the peculiarities of this blend will have to be considered . . . .

"The importance of a standard that is no more restrictive then is necessary to get the maximum reasonable safety under realistic use situations is particularly important for polyester/cotton blend fabrics. These fabrics comprise the major portion of apparel fabrics. They also are the types of fabrics which are the most difficult to flame retard to meet FF 3-71 and retain acceptable esthetics.

"We have been able to produce cellulosic fabrics, polyester fabrics acetate fabrics, modacrylics, blends of thermoplastic fibers, etc. to meet FF 3-71. Flame retardant polyester/cotton durable press fabrics meeting FF 3-71 have not been produced by a commercially viable process.

"The key technical problem is 'hand' of the treated fabrics. The hand of treated fabrics is objectionally stiff because of the necessity of using inordinately high add-ons of chemicals to pass FF 3-71. The modified test methods we have discussed would allow for much lower add-ons of chemicals to be used which would give a more acceptable hand to the treated fabrics. This would also lower the chemical cost of the finish . . . .

"Many apparel items—such as jackets, girls' dresses, hats, bathrobes, topcoats, etc.—may not be laundered 50 times during their life. Standards for apparel by end-use which require less extensive laundering would also allow for lower chemical add-ons to be used.

"A reasonable test method for polyester/cotton apparel fabrics should be developed as soon as possible so that FF 3-71 will not be adopted when new, more restrictive apparel standards may be required in the future." R. B. LeBlanc and D. A. LeBlanc, "Future Flammability Standards for Apparel: Can They be Reasonable and Practical, Too?," Textile Chemist and Colorist, Vol. 7, No. 5, 56/17 (April, 1975).

It has been discovered that novel flame retardant finishes are capable of rendering textile materials, including polyester/cotton blend fabrics, treated therewith flame retardant, i.e., capable of passing the U.S. Department of Commerce FF 3-71 flammability test. The flame retardant finishes of this invention impart durable flame retardancy as well as ease of care properties to fabrics and textiles treated therewith without significantly detrimentally affecting the hand of the treated fabrics and textiles.

SUMMARY OF THE INVENTION

A flame retardant finish comprising from about 15 to about 35 percent of a fire retardant compound of the formula

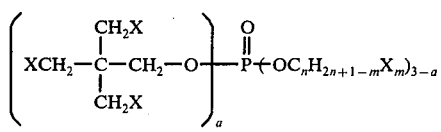

(I)

wherein each X is independently selected from chlorine, bromine, and hydrogen, wherein $a$ is an integer from 1 to 2, wherein $n$ is an integer from 1 to 8, and wherein $m$ is an integer from 0 to $n$, provided that when $n$ is 1, $m$ is 0; and mixtures thereof; from about 25 to about 45 percent of a water soluble quaternary phosphonium salt; from about 0.5 to about 10 percent of an emulsifying agent which is capable of passing the following three tests: (1) Solubility (Compatability Test: said emulsifying agent (20 parts by weight) must be completely soluble in 80 parts by weight of the flame retardant compound at not greater than 80° C.; (2) Shelf Life Test: a blend of said emulsifying agent and said flame retardant compound prepared as in the Solubility Test must remain in one clear homogeneous phase at 22° C. for at least 1 hour; (3) Finish Formulation Test: a flame retardant finish within the scope of this invention is prepared and must remain in one homogeneous phase for a minimum of 1 hour at 20° C.; from about 9 to about 16 percent of a water soluble organic nitrogen containing compound selected from the group consisting of

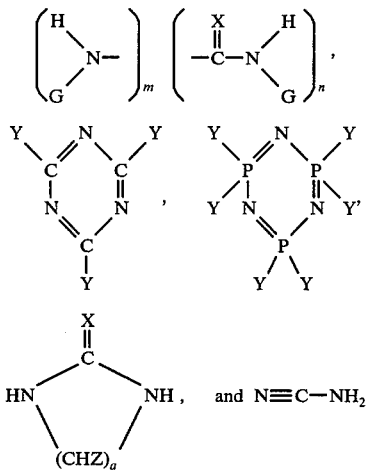

wherein each G is independently selected from the group comprising hydrogen, hydroxymethyl, alkyl containing 1 to 6 carbon atoms, amino, and cyano; X is selected from the group comprising oxygen, sulfur,=NH and=NC≡N; $m$ is an integer from 0 to 1, $n$ is an integer from 1 to 2 with the provision that $m + n$ equals 2; $a$ is an integer from 2 to 3; each Y independently is —NHG wherein G is defined above; and Z is selected from the group comprising hydrogen and hydroxyl; and from about 20 to about 32 percent of water.

The flame retardant finish of this invention imparts durable flame retardancy as well as ease of care properties to textiles and fabrics treated therewith. Furthermore, the finish does not require the use of flammable solvents.

DESCRIPTION OF THE PREFERRED EMBODIMENTS

The flame retardant finish of this invention is composed of several constituent parts. One of the constituent parts is a flame retardant compound which comprises from about 15 to about 35 percent, preferably from about 20 to about 30 percent, and more preferably from about 22 to about 27 percent of the flame retardant finish. The flame retardant compound is of the formula I above or mixtures thereof wherein each X is independently selected from chlorine, bromine, and hydrogen, wherein $a$ is an integer from 1 to 2, preferably 1, wherein $n$ is an integer from 1 to 8, preferably 3, and wherein $m$ is an integer from 0 to $n$, preferably 2, provided that when $n$ is 1, $m$ is 0. Preferably, each of the X substituents of the above flame retardant compound is independently selected from chlorine and bromine. More preferably, each of the X and Y substituents of the above flame retardant compound are bromine. Exemplary preferred compounds falling within the scope of the above formula include bis(2,3-dibromopropyl)-3-bromo-2,2-bis(bromomethyl)propyl phosphate, bis(2,3-dibromopropyl)-3-chloro-2,2-bis(methyl)propyl phosphate, and bis(2,3-dichloropropyl)-3-chloro-2,2-bis(-chloromethyl)propyl phosphate. Bis-(2,3-dibromopropyl)-3-bromo-2,2-bis(bromomethyl)propyl phosphate is the most preferred flame retardant within the scope of formula I.

A second constituent part of the flame retardant finish of this invention is an emulsifying agent which comprises from about 0.5 to about 10 percent, preferably from about 1 to about 8 percent, and more preferably from about 2 to about 6 percent of the flame retardant finish. The emulsifying agent is capable of passing the following three tests: (1) Solubility (Compatability) Test: said emulsifying agent (20 parts by weight) must be completely soluble in 80 parts by weight of the flame retardant compound at not greater than 80° C.; (2) Shelf Life Test: a blend of said emulsifying agent and the flame retardant compound prepared as in the Solubility Test must remain in one clear homogeneous phase at 22° C. for at least 1 hour, preferably at least 10 hours, and more preferably at least 20 hours; (3) Finish Formulation Test: a flame retardant finish within the scope of this invention is prepared and must remain in one homogeneous phase for a minimum of 1 hour, preferably for a minimum of 2 hours, and more preferably for a minimum of 4 hours at 20° C. The flame retardant compound used in the Solubility (Compatibility) Test and the Shelf Life Test is that flame retardant compound or mixture of flame retardant compounds which one desires to employ in the flame retardant textile finish to be formulated. By way of illustration, and not intended to be a limitation on the scope of this invention, phosphated nonionic emulsifiers and phosphated nonionic emulsifiers blended with another emulsifier selected from the group consisting of aliphatic and aromatic nonionic emulsifiers, are two groups of emulsifiers from which emulsifying agents may be selected which are capable of meeting the criteria of the above tests. Said phosphated nonionic emulsifiers and phosphated nonionic emulsifier blends preferably have an acid number of from about 30 to about 130, preferably from about 48 to about 120, and a phosphorus content of from about 2 to about 5 percent, preferably from about 2.2 to about 4 percent. Exemplary emulsifying agents capable of being employed in this invention include, but are not limited to, a blend of phosphted nonionic and unphosphated nonionic having an acid number of about 49.1 and a phosphorus content of about 2.31 percent and a phosphated nonionic having an acid number of about 118 and a phosphorus content of about 3.9 percent.

A third constituent part of the flame retardant finish of this invention is a water soluble quaternary phosphonium salt which comprises from about 25 to about 45 percent, preferably from about 30 to about 40 percent, and more preferably about 33.8 percent of the flame retardant finish. The water soluble quaternary phosphonium salt is selected from the group comprising tetrakis(hydroxymethyl)phosphonium and tetrakis(methylhydroxymethyl)phosphonium salts wherein the anion is derived from organic or inorganic, mono or polybasic acids and blends thereof. Examples of inorganic monobasic acids include hydrochloric, hydrofluoric, hydrobromic, hydroiodic, and nitric acids. Examples of inorganic polybasic acids include sulfuric and phosphoric acids. Examples of organic monobasic acids include acetic, propionic, benzoic, methylsulfonic, p-toluenesulfonic, benzenesulfonic, stearic formic, lactic, and picric acids. Examples of organic polybasic acids include oxalic, malic, maleic ethylene diamine hydroxymethyl triacetic, ethylene diamine tetraacetic and tartaric acid. The water soluble quaternary phosphonium salt is preferably a tetrakis(hydroxymethyl)phosphonium salt selected from the group comprising tetrakis(hydroxymethyl)phosphonium phosphate acetate, tetrakis(hydroxymethyl)phosphonium chloride, tetrakis(hydroxymethyl)phosphonium oxalate, and bis(tetrakis(hydroxymethyl)phosphonium)sulfate. The more preferred tetrakis(hydroxymethyl)phosphonium salts for use in this invention's flame retardant finish are tetrakis(hydroxymethyl)phosphonium oxalate and tetrakis(hydroxymethyl)phosphonium phosphate acetate, the latter being most preferred.

A fourth constituent part of the flame retardant finish of this invention is a water soluble organic nitrogen containing compound which comprises from about 9 to about 16 percent, preferably from about 11 to about 14 percent, and more preferably about 12.4 percent of the flame retardant finish. Said nitrogen containing compound is selected from the group consisting of

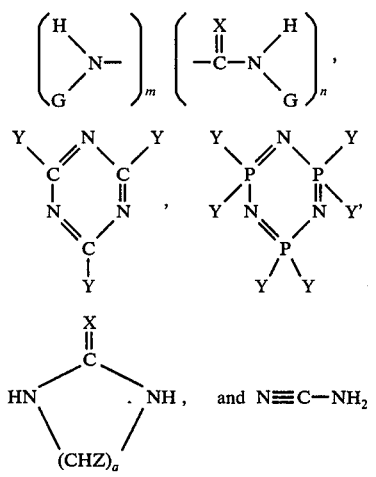

wherein each G is independently selected from the group comprising hydrogen, hydroxymethyl, alkyl containing 1 to 6 carbon atoms, amino, and cyano; X is selected from the group comprising oxygen, sulfur, =NH, and =NC≡N; $m$ is an integer from 0 to 1; $n$ is an integer from 1 to 2 with the provision that $m + n$ equals 2; $a$ is an integer from 2 to 3; each Y independently is —NHG wherein G is defined above; and Z is selected from the group comprising hydrogen and hydroxyl; preferably G is selected from the group comprising hydrogen, hydroxymethyl, amino, and cyano; and all G substituents are preferably the same. Exemplary compounds within the broad class of water soluble organic nitrogen containing compounds that may be used in this invention's flame retardant finish include urea, thiourea, guanidine, dicyandiamide, melamine, trimethylol melamine, aminocyclophosphazene, N-methylocyclophosphazene, ethylene urea, propylene urea, cyanamide and oxamide. Preferred water soluble organic nitrogen containing compounds include urea, thiourea, guanidine, dicyandiamide, melamine, ethylene urea, and propylene urea, with urea being the most preferred compound.

A fifth constituent part of the flame retardant finish of this invention is water which comprises from about 20 to about 32 percent, preferably from about 23 to about 29 percent, and more preferably about 25.8 percent of the flame retardant finish.

The flame retardant finish of this invention may optionally have incorporated therein a wetting agent. If the wetting agent is a constituent part of the flame retardant finish, the wetting agent would comprise from about 0.1 to about 1 percent, preferably from about 0.2 to about 0.8 percent, and more preferably about 0.6 percent of the flame retardant finish. The wetting agents which may be employed in this invention may be selected from the group comprising anionic, nonionic, and nonionic-anionic blend wetting agents. Exemplary wetting agents include an anionic phosphate surfactant in free acid form, a nonionic nonylphenyl polyethylene glycol ether, a nonionic octylphenoxy polyethoxy ethanol, a nonionic trimethyl nonyl polyethylene glycol ether, and a nonionic polyethylene glycol ether of linear alcohol. These and other wetting agents are well known to people skilled in the fabric treating art (e.g., McCutcheon's Detergents and Surfactants, Allied Publishing Corp., 1974).

A preferred method of making the flame retardant finish of this invention involves adding the desired amounts of the various constituents in the following sequence:

(1) Mix an aqueous solution of the desired above described water soluble quaternary phosphonium salt with the wetting agent, if used, and with the remaining amount of water to be used,
(2) while stirring (1), add an emulsion concentrate comprising the above described flame retardant compound and the above described emulsifying agent, and
(3) add to the intermediate flame retardant finish of (2) (hereinafter referred to as "intermediate flame retardant finish A") the desired water soluble organic nitrogen containing compound while stirring.

Another preferred method of making the flame retardant of this invention involves adding the desired amounts of the various constituents in the following sequence:

(1) Mix an aqueous solution of the desired above described water soluble quaternary phosphonium salt with the wetting agent, if used,
(2) while stirring (1), add an emulsion concentrate comprising the above described flame retardant compound and the above described emulsifying agent,
(3) while stirring add to the intermediate flame retardant finish of (2) (hereinafter referred to as "intermediate flame retardant finish B") the remaining amount of water to be used, and
(4) add to (3) the desired water soluble organic nitrogen containing compound while stirring.

The above intermediate flame retardant finish A can contain from about 20 to about 35 percent, preferably from about 22 to about 32 percent, and more preferably from about 25 to about 29 percent of the above described flame retardant compound; from about 0.5 to about 11 percent, preferably from about 1.5 to about 8.5 percent, and more preferably from about 3 to about 7 percent, of the above described emulsion; from about 34 to about 43 percent, preferably from about 36 to about 41 percent, and more preferably about 38.6 percent, of the above described water soluble quaternary phosphonium salt; and from about 26 to about 33 percent, preferably from about 27 to about 31 percent, and more preferably about 29.4 percent water.

The above intermediate flame retardant finish B can contain from about 22 to about 38 percent, preferably from about 24 to about 35 percent, and more preferably from about 28 to about 32 percent of the above described flame retardant compound; from about 0.5 to about 12 percent, preferably from about 1.5 to about 10 percent, and more preferably from about 3.5 to about 7 percent of the above described emulsion; from about 38 to about 47 percent, preferably from about 40 to about 45 percent, and more preferably about 42.3 percent, of the above described water soluble quaternary phosphonium salt; and from about 20 to about 25 percent preferably from about 21 to about 24 percent, and more preferably about 22.7 percent water.

By combining the ranges of intermediate flame retardant finishes A and B, it can be said that the intermediate flame retardant composition of this invention may contain from about 20 to about 38 percent, preferably from about 22 to about 35 percent, and more preferably from about 25 to about 32 percent of the above described flame retardant compound; from about 0.5 to about 12 percent, preferably from about 1.5 to about 10 percent, and more preferably from about 3 to about 7 percent of the above described emulsion; from about 34 to 47 percent, preferably from about 38 to about 43 percent of the above described water soluble quaternary phosphonium salt; and from about 20 to about 33 percent, preferably from about 21 to about 31 percent, and more preferably from about 22 to about 30 percent water.

Also, each of the above intermediate flame retardant compositions may optionally contain from about 0.2 to about 0.8 percent of the above described wetting agent.

The intermediate flame retardant compositions of this invention, i.e., compositions containing the above described water soluble quaternary phosphonium salt, the above described flame retardant, the above described emulsifying agent, and the above described wetting agent, if used, can be used in the ammonia cure process wherein a fabric substrate is treated with said intermediate flame retardant composition and then introduced into an ammonia environment. For a more detailed description of the ammonia cure process see F. H. Day, "The Fire-Stop™ Flame Retardant Process for Cotton Textiles," Proceedings of the 1973 Symposium on Textile Flammability, 41, LeBlanc Research Corporation, 5454 Post Road, East Greenwich, Rhode Island, 1974, and G. Hooper, "Phosphine-Based Fire Retardants for Cellulosic Textiles," Proceedings of the 1973 Symposium on Textile Flammability, 50, LeBlanc Research Corporation, 5454 Post Road, East Greenwich, Rhode Island, 1973, both articles incorporated herein in toto by reference. It should be specifically noted that the ammonia acts in place of the water soluble organic nitrogen containing compound to react with the water soluble quaternary phospnonium salt of the intermediate flame retardant finish to form a highly cross-linked water insoluble phosphorus and nitrogen polymer.

The flame retardant emulsion concentrate, supra, can contain from about 70 to about 97 percent, preferably from 75 to about 95 percent, and more preferably from about 80 to about 90 percent of the above described flame retardant; and from about 3 to about 30 percent, preferably about 5 to about 25 percent and more preferably from about 10 to about 20 percent of the above described emulsifying agent.

Also within the scope of this invention is an emulsion which can comprise from about 8 to about 50 percent, preferably from about 15 to about 40 percent, and more preferably from about 20 to about 30 percent, of the above described flame retardant compound; from about 0.2 to about 22 percent, preferably from about 0.8 to about 14 percent, and more preferably from about 2 to about 8 percent, of the above described emulsifying agent; and from about 28 to about 92 percent, preferably from about 46 to about 85 percent, and more preferably from about 62 to about 78 percent of water.

In addition to being capable of using the above described emulsifying agent in this invention's emulsion or emulsion concentrate, it is also possible to use another emulsifying agent having all the characteristics of the above described emulsifying agent save that the Finish Formulation Test is eliminated and an Emulsion Stability Test substituted therefor. The Emulsion Stability Text entails mixing a blend of 20 parts by weight of said emulsifying agent and 80 parts by weight of the flame retardant compound and converting said blend into a stable aqueous emulsion using the following procedure: (1) heat 500 gms of deionized water to 93° to 100° C.; (2) while stirring, slowly add 250 gms of said blend and continue stirring for 15 minutes after final blend addition, maintaining the emulsion temperature at 96° C. for 15 minutes; (3) while stirring, add sufficient cold water to bring the total weight of the emulsion to 1000 gms. The above prepared emulsion must be stable for at least 1 hour, preferably at least 2 hours, and more preferably at least 4 hours.

It should also be noted that the above discussion concerning the preferred flame retardant compounds, the preferred water soluble quaternary phosphonium salt, and the preferred water soluble organic nitrogen containing compounds of the flame retardant finish is equally applicable to the emulsion concentrate, emulsion, and intermediate flame retardant finish, where appropriate.

The flame retardant finish can be applied to textile fabrics by a pad, dry, cure and oxidative afterwash procedure. The temperature of the flame retardant finish during application should be maintained at a temperature of from about 0° to about 28° C. and preferably from about 15° to about 21° C. If necessary, the desired temperature during the padding procedure is maintained by using any suitable heat transfer means such as circulating water through the jacket on the pad box containing the flame retardant finish. When warm rolls of fabric are processed, pass the fabric over cooling means, such as cooling cans, before treating the fabric. The temperature of the finishing bath must be closely controlled or premature polymerization can occur at temperatures above 32° C. Also, inadequate control of the finishing bath temperature might cause non-uniform flame retardancy during long finishing runs.

The textile fabrics should be padded by suitable means such that the wet pick-up is from about 25 to about 150 percent and preferably from about 60 to about 90 percent of the weight of the untreated fabric.

The exact amount of finish applied depends upon the degree of reduced flammability desired. One suitable set of padding conditions includes padding the fabric at from about 6 to 10 tons of pressure using a 1 dip/1 nip or a 2 dip/2 nip fabric lacing and an immersion time of from about 10 to about 12 seconds followed by subjecting the treated fabric to squeezing means to obtain the desired wet pick-up on the treated fabric.

The treated textile fabrics should be dried, preferably frame dried, slightly over the finished width, at from about 100° to about 130° C. and preferably from about 104° to about 110° C.

Curing of the dried fabrics can be done at from about 150° to about 205° C. for from about 90 seconds to about 480 seconds; preferably the curing will be done at about 160° C. for about 300 seconds or at 205° C. for about 120 seconds.

Although fabric drying and curing can take place simultaneously, it is preferred that separate drying and curing operations be performed.

The phosphorus in the treated fabric is oxidized to the +5 valence state by padding the fabric with a solution containing an effective amount of about 5 percent of an oxidizing agent at a temperature of from about 76° to about 83° C. The oxidization treatment and skying time should be such as to insure complete oxidation of the phosphorus in the finish, e.g., from about 30 to about 60 seconds. Both acidic and basic oxidizing agents or conditions may be used. Preferred oxidizing agents include hydrogen peroxide and sodium perborate.

After treatment with the oxidizing solution, the fabric is hot rinsed in water at a temperature of from about 71° to about 83° C. neutralized with a dilute solution of from about 0.1 to about 1.0 percent and preferably about 0.5 percent soda ash, said solution having a temperature of about 37° C; rinsed at about 83° C. and again at 37° C. and dried at about 93° to about 122° C. Optionally, about 0.25 percent of a wetting agent, such as those described above, can be present in the oxidizing solution.

Many textile fabrics can be treated with the flame retardant finish of this invention. Examples of such textile fabrics include cellulosics, rayon, acrylics, polyesters, acetates, nylon, and textile fabrics derived from animal fibers, such as wool and mohair, and blends thereof. Typical blends would include 35/65, 50/50 and 65/35 blends of polyester/cotton, 50/50 blend of polyester/rayon, and 50/50 blend of acrylic/cotton. Since prior art methods of and means for flame retarding polyester/cotton blend fabrics have proven ineffective, this invention is especially useful for such blends.

The flame retardant finish of this invention, unlike latex base flame retardant systems, does not require the use of a release agent during the fabric processing procedure.

The following examples are provided for the purpose of further illustration only and are not intended to be limitations on the disclosed invention. Unless otherwise specified, all temperatures are expressed in degrees centigrade; all weights are expressed in grams; and all volumes are expressed in milliliters.

EXAMPLE 1

Ten panels of a 50/50 spun blended polyester and cotton poplin (Style #9503 Testfabric, Inc., Middlesex, New Jersey) were treated with finishing formulation A, infra, by a pad, dry, cure and oxidative after wash procedure.

Formula A 51.9% Tetrakis (hydroxymethyl) phosphonium phosphate acetate, 65% aqueous solution
7.4% Water
0.4% Wetting agent[1]
12.4% Urea
27.9% Emulsion Concentrate consisting of:
90.0% Bis(2,3-dibromopropyl)-3-bromo-2,2-bis(-bromomethyl)propyl phosphate
10.0% Emulsifying Agent[2]

[1]The wetting agent was a nonionic trimethyl nonyl polyethylene glycol ether having an HLB value of 10.1. (Tergitol TMN-6 brand wetting agent, Union Carbide Corp., New York, NY) [2]The emulsifying agent was a blend of phosphated and unphosphated nonionic having an acid number of about 49.1 and a phosphorus content of about 2.31 percent. (AM2-10C brand emulsifying agent, Witco Chemical Co., Inc., Chicago, IL.)

The wet pick-up of the finish was 84.5%. All 10 treated panels were dried at 105° C. Five panels were then cured for 5 minutes at 160° C. and the other five were cured for 2 minutes at 205° C. All panels were then oxidized in the open with as follows:

(1) Pad 3 times at 30 pounds per square inch (psi) through a 5% hydrogen peroxide (100%) and 0.25% Tergitol TMN-6 brand wetting agent solution based on the weight of fabric (owf);
(2) Pad 3 times through hot water;
(3) Pad 2 times through a 5% sodium carbonate solution;
(4) Pad 2 times through hot water; and
(5) Frame dry for 5 minutes at 105° C.

EXAMPLE 2

The same fabric used in Example 1 was treated according to the processing procedure as described in Example 1 (cured for 5 minutes at 160° C.) using the finishing formulation B, infra.

Formula B 51.9% Tetrakis(hydroxymethyl)phosphonium phosphate acetate, 65% aqueous solution
35.3% Water
0.4% Wetting Agent[1]
12.4% Urea

[1]The wetting agent was the same as that employed in Example 1.

The wet pick-up was 49.1%.

EXAMPLE 3

The flame retardancy of the treated fabrics of Examples 1 and 2 was evaluated using the procedures established by the "Standard for the Flammability of Children's Sleepwear", U.S. Department of Commerce FF 3-71 (DOC FF 3-71). The durability of the flame retardant treatment was determined by measuring the char lengths of the treated fabrics after multiple laundering and drying cycles as set forth in DOC FF 3-71, incorporated herein in toto by reference.

Char length data for the untreated fabric and the treated fabrics of Examples 1 and 2 are shown in the following Table I

TABLE I

| | Char Length, Inches (DOC FF 3-71) | | | | | |
|---|---|---|---|---|---|---|
| | Laundering and Drying Cycles | | | | | |
| | 0 | 10 | 20 | 30 | 40 | 50 |
| Untreated | BEL[1] | N.D.[2] | N.D. | N.D. | N.D. | N.D. |
| Example #1 | | | | | | |
| 160° C cure | N.D. | N.D. | 2.1 | 2.3 | 3.0 | 3.1 |
| 205° C. cure | N.D. | N.D. | 2.1 | 2.3 | 5.5 | 2.8 |

TABLE I-continued

| | Char Length, Inches (DOC FF 3-71) | | | | | |
|---|---|---|---|---|---|---|
| | Laundering and Drying Cycles | | | | | |
| | 0 | 10 | 20 | 30 | 40 | 50 |
| Example #2 | N.D. | BEL | N.D. | N.D. | N.D. | N.D. |

(1)BEL - Specimen burned the entire length.
(2)N.D. means not determined.

The above specification as well as the examples contained therein clearly establish that the novel flame retardant finishes of this invention are capable of rendering textile materials, including polyester/cotton blend fabrics, treated therewith flame retardant, i.e., capable of passing the DOC FF 3-71 flammability test, while not significantly detrimentally affecting the hand of the treated fabrics and textiles. In view of the infantile state of the prior art, see G. C. Tesoro, supra, the novel characteristics of polyester/cotton blend fabrics, see Textile Research Institute's press release, supra, the misdirections of the prior art, see V. Mischutin and Dr. W. F. Battinger, supra, and the need for an effective commercial flame retardant capable of meeting the requirements of DOC FF 3-71, see R. B. LeBlanc and D. A. LeBlanc, supra, the present invention must truly be considered a giant step forward in the art of rendering textiles and fabrics flame retardant.

Based on this disclosure, many other modifications and ramifications will naturally suggest themselves to those skilled in the art. These are intended to be comprehended as within the scope of this invention.

The embodiments of the invention in which an exclusive property or privilege is claimed are defined as follows:

1. A flame retardant textile finish, said textile being cotton or a blend of cotton and polyester fibers, consisting essentially of:

(a) from about 15 to about 35 percent of a flame retardant compound of the formula

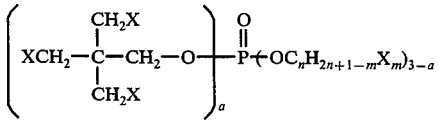

wherein each X is independently selected from chlorine, bromine, and hydrogen, wherein $a$ is an integer from 1 to 2, wherein $n$ an integer from 1 to 8, and wherein $m$ is an integer from 0 to $n$, provided that when $n$ is 1, $m$ is 0, and mixtures thereof;

(b) from about 0.5 to about 10 percent of an emulsifying agent which is capable of passing the following three tests: (1) Solubility (Compatability) Test: said emulsifying agent (20 parts by weight) must be soluble in 80 parts by weight of said flame retardant compound at no more than 80° C.; (2) Shelf Life Test: a blend of said emulsifying agent and said flame retardant compound prepared as in the Solubility Test must remain in one clear homogeneous phase at 22° C. for at least 1 hour; (3) Finish Formulation Test: a flame retardant finish within the scope of this invention is prepared and must remain in one homogeneous phase for a minimum of 1 hour at 20° C.;

(c) from about 25 to about 45 percent of a water soluble quaternary phosphonium salt selected from the group consisting of tetrakis (hydroxymethyl) phosphonium and tetrakis(methylhydroxymethyl)-phosphonium salt;

(d) from about 9 to about 16 percent of a water soluble organic nitrogen containing compound selected from the group consisting of urea, thiourea, guanidine, and dicyandiamide; and (e) from about 20 to about 32 percent of water.

2. The flame retardant finish of claim 1 consisting essentially of:

(a) from about 20 to about 30 percent of said flame retardant compound wherein each X is independently selected from chlorine and bromine, $a$ is 1, $n$ is 3, and $m$ is 2;

(b) from about 1 percent to about 8 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and the flame retardant compound prepared as in the Solubility Test must remain in one clear homogeneous phase at 22° C. for at least 10 hours; (3) Finish Formulation Test: a flame retardant finish within the scope of this invention is prepared and must remain in one homogeneous phase for a minimum of 2 hours at 20° C.;

(c) from about 30 to about 38 percent of said water soluble quaternary phosphonium salt, said quaternary phosphonium sale being a tetrakis(hydroxymethyl)phosphonium salt selected from the group consisting of tetrakis(hydroxymethyl)phosphonium oxalate, tetrakis(hydroxymethyl)phos phonium phosphate acetate, tetrakis(hydroxymethel)phosphonium choride, and bis(tetrakis(hydroxymethyl)phosphonium)sulfate;

(d) from about 11 to about 14 percent of said water soluble organic nitrogen compound; and (e) from about 20 to about 31 percent of water.

3. The flame retardant finish of claim 1 wherein said flame retardant compound is selected from the group consisting of bis(2,3-dibromopropyl)-3-bromo-2,2-bis(-bromomethyl)propyl phosphate, bis(2,3-dibromopropyl)-3-chloro-2,2-bis(methyl)propyl phosphate, bis(2,3-dichloropropyl)-3-chloro-2,2-bis(chloromethyl)-propyl phosphate, and mixtures thereof, and wherein sid emulsifying agent is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and the flame retardant compound prepared as in the Solubility Test must remain in one clear homogeneous phase at 22° C. for at least 20 hours; (3) Finish Formulation Test: a flame retardant finish within the scope of this invention is prepared and must remain in one homogeneous phase for a minimum of 4 hours at 20° C.

4. The flame retardant finish of claim 3 wherein said flame retardant compound is bis(2,3-dibromopropyl)-3-bromo-2,2-bis(bromomethyl)propyl phosphate and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 percent to about 5 percent.

5. The flame retardant finish of claim 4 wherein said water soluble organic nitrogen containing compound in urea.

6. The flame retardant finish of claim 3 wherein said tetrakis(hydroxymethyl)phosphonium salt is selected from the group consisting of tetrakis(hydroxymethyl)-phosphonium oxalate and tetrakis(hydroxymethyl)-phosphonium phosphate acetate.

7. The flame retardant finish of claim 3 wherein said flame retardant compound is bis(2,3-dibromopropyl)-3-bromo-2,2-bis(bromomethyl)propyl phosphate, wherein said water soluble organic nitrogen containing compound is urea, wherein said tetrakis(hydroxymethyl)-phosphonium salt is tetrakis(hydroxymethyl)phosphonium phosphate acetate, and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 to about 5 percent.

8. The flame retardant finish of claim 3 which also contains from about 0.2 percent to about 0.8 percent of wetting agent.

9. The flame retardant finish of claim 3 comprising:

(a) from about 22 to about 26 percent of said flame retardant compound;
(b) from about 2 to about 6 percent of said emulsifying agent;
(c) about 33.8 percent of said tetrakis(hydroxymethyl)phosphonium salt;
(d) about 12.4 percent of said water soluble organic nitrogen containing compound; and
(e) about 25.8 percent of said water.

10. The flame retardant finish of claim 9 wherein said flame retardant compound is bis(2,3-dibromopropyl)-3-bromo-2,2-bis(bromomethyl)propyl phosphate and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorous content of about 2 percent to about 5 percent.

11. The flame retardant finish of claim 10 wherein said water soluble organic nitrogen containing compound is urea.

12. The flame retardant finish of claim 9 wherein said tetrakis(hydroxymethyl)phosphonium salt is selected from the group consisting of tetrakis(hydroxymethyl)-phosphonium oxalate and tetrakis(hydroxymethyl)-phosphonium phosphate acetate.

13. The flame retardant finish of claim 12 wherein said flame retardant compound is bis(2,3-dibromopropyl)-3-bromo-2,2-bis(bromomethyl)propyl phosphate, wherein said water soluble organic nitrogen containing compound is urea, and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 percent to about 5 percent.

14. The flame retardant finish of claim 13 wherein said tetrakis(hydroxymethyl)phosphonium salt is tetrakis(hydroxymethyl)phosphonium oxalate.

15. The flame retardant finish of claim 13 wherein said tetrakis(hydroxymethyl)phosphonium salt is tetrakis(hydroxymethyl)phosphonium phosphate acetate.

16. The flame retardant finish of claim 9 which also contains about 0.6 percent of wetting agent.

17. The flame retardant finish of claim 2 wherein said flame retardant is bis(2,3-dibromopropyl)-3-chloro-2,2-bis(methyl)propyl phosphate.

18. The flame retardant finish of claim 2 wherein said flame retardant compound is bis(2,3-dichloropropyl)-3-chloro-2,2-bis(chloromethyl)propyl phosphate.

19. The flame retardant finish of claim 2 wherein said flame retardant compound is bis(2,3-dibromopropyl)-3-bromo-2,2-bis(bromomethyl)propyl phosphate.

20. The flame retardant finish of claim 1 wherein a, n, m, and X of said flame retardant compound are, respectively 1, 3, 2, and each independently selected from chlorine and bromine; wherein said emulsifying agent is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and the flame retardant compound prepared as in the Solubility Test must remain in one clear homogeneous phase at 22° C. for at least 10 hours; (3) Finish Formulation Test: a flame retardant finish within the scope of this invention is prepared and must remain in one homogeneous phase for a minimum of 2 hours at 20° C.; wherein said water soluble quaternary phosphonium salt is a tetrakis(hydroxymethyl)phosphonium salt selected from the group consisting of tetrakis(hydroxymethyl)-phosphonium oxalate, tetrakis(hydroxymethyl)phosphonium phosphate acetate, tetrakis(hydroxymethyl)phsophonium chloride, and bis(tetrakis(hydroxymethyl)phosphonium)sulfate.

21. The flame retardant finish of claim 20 wherein said flame retardant compound is selected from the group consisting of bis(2,3-dibromopropyl)-3-bromo-2,2-bis(bromomethyl)propyl phosphate, bis(2,3-dibromopropyl)-3-chloro-2,2-bis(methyl)propyl phosphate, and bis(2,3-dichloropropyl)-3-chloro-2,2-bis(-chloromethyl)propyl phosphate and wherein said emulsifying agent is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and the flame retardant compound prepared as in the Solubility Test must remain in one clear homogeneous phase at 22° C. for at least 20 hours; (3) Finish Formulation Test: a flame retardant finish within the scope of this invention is prepared and must remain in one homobeneous phase for a minimum of 4 hours at 20° C.

22. The flame retardant finish of claim 21 wherein said flame retardant compound is bis(2,3-dibromopropyl)-3-bromo-2,2-bis(bromomethyl)propyl phosphate and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 percent to about 5 percent.

23. The flame retardant finish of claim 21 wherein said water soluble organic nitrogen containing compound is urea.

24. The flame retardant finish of claim 21 wherein said tetrakis(hydroxymethyl)phosphonium salt is selected from the group consisting of tetrakis(hydroxymethyl)phosphonium oxalate and tetrakis(hydroxymethyl)phosphonium phosphate acetate.

25. The flame retardant finish of claim 24 wherein said flame retardant is bis(2,3-dibromopropyl)-3-bromo-2,2-bis(bromomethyl)propyl phosphate, wherein said water soluble organic nitrogen containing compound is urea, wherein said tetrakis(hydroxymethyl)phosphonium salt is tetrakis(hydroxymethyl)phosphonium phosphate acetate, and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 to about 5 percent.

26. The flame retardant finish according to claim 20 which also contains from about 0.1 to about 1.0 percent of a wetting agent.

27. The flame retardant finish according to claim 1 which also contains from about 0.1 to about 1.0 percent of a wetting agent.

28. A process for treating textile materials to render them flame retardant which comprises applying to said textile the flame retardant finish of claim 1.

29. A textile material obtained by the process of claim 28.

30. An emulsion concentrate for use in preparing the flame retardant of claim 1 comprising:

(a) from about 70 to about 97 percent of a flame retardant compound of the formula

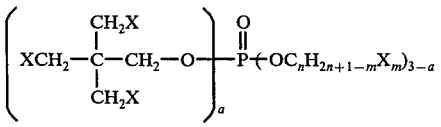

wherein each X is independently selected from chlorine, bromine, and hydrogen, wherein *a* is an integer from 1 to 2, wherein *n* is an integer from 1 to 8, and wherein *m* is an integer from 0 to *n*, provided that when *n* is 1, *m* is 0, and mixtures thereof;

(b) from about 3 to about 30 percent of an emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 1 hour; (3) Finish Formulation Test: a flame retardant finish within the scope of this invention is prepared and must remain in one homogeneous phase for a minimum of 1 hour at 20° C.

31. The emulsion concentrate of claim 30 comprising:

(a) from about 75 to about 95 percent of said flame retardant compound; and (b) from about 5 to about 25 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.: (2) Shelf Life Test: a blend of said emulsifying agent and said flame retardant compound prepared as in the Solubility Test must remain in one clear homogeneous phase at 22° C. for at least 10 hours; (3) Finish Formulation Test: a flame retardant finish within the scope of this invention is prepared and must remain in one homogeneous phase for a minimum of 2 hours at 20° C.

32. The emulsion concentrate of claim 31 comprising:

(a) from about 80 to about 90 percent of said flame retardant compound; and (b) from about 10 to about 20 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 20 hours; (3) Finish Formulation Test: a flame retardant finish within the scope of this invention is prepared and must remain in one homogeneous phase for a minimum of 4 hours at 20° C.

33. The emulsion concentrate of claim 30 wherein *a*, *n*, *m*, and X of said flame retardant compound are, respectively, 1, 3, 2, and each independently selected from chlorine and bromine; and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 to about 5 percent.

34. The emulsion concentrate of claim 33 wherein said flame retardant compound is selected from the group consisting of bis(2,3-dibromopropyl)-3-bromo-2,2-bis(bromomethyl)propyl phosphate, bis(2,3-dibromopropyl)-3-chloro-2,2-bis(methyl)propyl phosphate, and bis(2,3-dichloropropyl)-3-chloro-2,2-bis(chloromethyl)propyl phosphate and wherein said emulsifying agent has an acid number from about 30 to about 130 and a phosphorus content from about 2 to about 5 percent.

35. The emulsion concentrate of claim 34 wherein said flame retardant is bis(2,3-dibromopropyl)-3-bromo-2,2-bis(bromomethyl)propyl phosphate and wherein said emulsifying agent has an acid number from about 48 to about 120 and a phosphorus content from about 2.2 percent to about 4 percent.

36. The emulsion concentrate of claim 30 wherein said emulsifying agent is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 1 hour; (3) Emulsion Stability Test: a blend of said emulsifying agent and said flame retardant compound prepared as in the Solubility Test must remain in a stable aqueous emulsion for at least 1 hour, said aqueous emulsion being prepared as follows: (a) heat 500 gms of deionized water to 93° to 100° C.; (b) while stirring, slowly add 250 gms of said blend to said heated deionized water and continue stirring for 25 minutes after final blend addition, maintaining the emulsion temperature at 96° C. for 15 minutes; and (c) while stirring, add sufficient cold water to bring the total weight of the emulsion up to 1000 gms.

37. An emulsion for use in preparing the flame retardant of claim 1 comprising (a) from about 8 to about 50 percent of a flame retardant compound of the formula

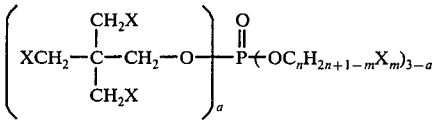

wherein each X is independently selected from chlorine, bromine, and hydrogen, wherein *a* is an integer from 1 to 2, wherein *n* is an integer from 1 to 8, and wherein *m* is an integer from 0 to *n*, provided that when *n* is 1, *m* is 0, and mixtures thereof;

(b) from about 0.2 to about 22 percent of an emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 1 hour; (3) Finish Formulation Test: a flame retardant finish within the scope of this invention is prepared and must remain in one homogeneous phase for a minimum of 1 hour at 20° C.; and (c) from about 28 to about 92 percent of water.

38. The emulsion of claim 37 comprising:

(a) from about 15 to about 40 percent of said flame retardant compound;

(b) from about 0.8 to about 14 percent of said emulsifying agent which is capable of passing the following three tests: (1) Solubility (Compatability) Test: said emulsifying agent (20 part by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneos phase at 22° C. for at least 10 hours; (3) Finish Formulation Test: a flame retardant finish within the scope of this invention is prepared and must remain in one homogeneous phase for a minimum of 2 hours at 20° C.; and (c) from about 45 to about 85 percent of said water.

39. The emulsion of claim 38 comprising:

(a) from about 20 to about 30 percent of said flame retardant compound;

(b) from about 2 to about 8 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 20 hours; (3) Finish Formulation Test: a flame retardant finish within the scope of this invention is prepared and must remain in one homogeneous phase for a minimum of 4 hours at 20° C.;

(c) from about 52 percent to about 78 percent of said water.

40. The emulsion of claim 37 wherein *a, n, m,* and X of said flame retardant compound are, respectively, 1, 3, 2, and each independently selected from chlorine and bromine; and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 to about 5 percent.

41. The emulsion of claim 40, wherein said flame retardant compound is selected from the group consisting of bis(2,3-dibromopropyl)-3-bromo-2,2-bis(-bromomethyl)propyl phosphate, bis(2,3-dibromopropyl)-3-chloro-2,2-bis(methyl)propyl phosphate, and bis(2,3-dichloropropyl)-3-chloro-2,2-bis(chloromethyl)-propyl phosphate and wherein said emulsifying agent has an acid number from about 30 to about 130 and a phosphorus content from about 2 to about 5 percent.

42. The emulsion of claim 41 wherein said flame retardant compound is bis(2,3-dibromopropyl)-3-bromo-2,2-bis(bromomethyl)propyl phosphate and wherein said emulsifying agent has an acid number from about 48 to about 120 and a phosphorus content from about 2.2 to about 4.0 percent.

43. An intermediate flame retardant composition for use in preparing the flame retardant of claim 1 comprising:

(a) from about 20 to about 38 percent of a flame retardant compound of the formula:

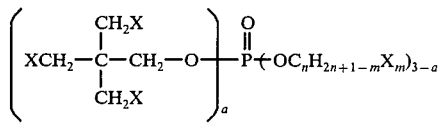

wherein each X is independently selected from chlorine, bromine, and hydrogen, wherein *a* is an integer from 1 to 2, wherein *n* is an integer from 1 to 8, and wherein *m* is an integer from 0 to *n*, provided that when *n* is 1, *m* is 0, and mixtures thereof.

(b) from about 0.5 to about 12 percent of an emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 1 hour; (3) Finish Formulation Test: a flame retardant finish within the scope of this invention is prepared and must remain in one homogeneous phase for a minimum of 1 hour at 20° C.;

(c) from about 34 to about 47 percent of a water soluble quaternary phosphonium salt selected from the group consisting of tetrakis(hydroxymethyl) phosphonium and tetrakis(methylhydroxymethyl) phosphonium salts; and (d) from about 20 to about 33 percent of water.

44. The intermediate flame retardant composition of claim 43 comprising:

(a) from about 22 to about 35 percent of said flame retardant compound;

(b) from about 1.5 to about 10 percent of said emulsifying agent which is capable of passing the following three tests: (1) Solubility (Compatability) Test: said emulsifying agent (20 parts by weight) must be soluble in 80 parts by weight of the flame retardant compound at no less than 80° C.; (2) Shelf Life Test: a blend of said emulsifying agent and said flame retardant compound prepared as in the Solubility Test must remain in one clear homogeneous phase at 22° C. for at least 10 hours; (3) Finish Formulation Test: a flame retardant finish within the scope of this invention is prepared and must remain in one homogeneous phase for a minimum of 2 hours at 20° C.;

(c) from about 36 to about 45 percent of said water soluble quaternary phosphonium salt; and (d) from about 21 to about 31 percent of water.

45. The intermediate flame retardant finish of claim 44 comprising:

(a) from about 25 to about 32 percent of said flame retardant compound;

(b) from about 3 to about 7 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 20 hours; (3) Finish Formulation Test: a flame retardant finish within the scope of this invention is prepared and must remain in one homogeneous phase for a minimum of 4 hours at 20° C.;

(c) from about 38 to about 43 percent of said water. soluble quaternary phosphonium salt; and (d) from about 22 to about 30 percent of water.

46. The intermediate flame retardant composition of claim 43 wherein *a, n, m,* and X of said flame retardant compound are, respectively, 1, 3, 2, and each independently selected from chlorine and bromine; wherein said emulsifying agent is selected from the group consisting of phosphated nonionic emulsifiers and phosphated non-ionic emulsifiers blended with another emulsifier selected from the group consisting of aliphatic and aromatic nonionic emulsifiers, said emulsifying agent having an acid number of about 30 to about 130 and a phosphorus content of about 2 to about 5 percent; and wherein said water soluble quaternary phosphonium salt is a tetrakis(hydroxymethyl)phosphonium salt selected from the group consisting of tetrakis(hydroxymethyl)phosphonium oxalate, tetrakis(-hydroxymethyl)phosphonium acetate, tetrakis(hydroxymethyl)phosphonium chloride, and bis(tetrakis(hydroxymethyl)phosphonium)sulfate.

47. The intermediate flame retardant composition of claim 46 wherein said flame retardant compound is selected from the group consisting of bis(2,3-dibromopropyl)-3-bromo-2,2-bis(bromomethyl)propyl phosphate, bis(2,3-dibromopropyl)-3-chloro-2,2-bis(methyl)-propyl phosphate, and bis(2,3-dichloropropyl)-3-chloro-2,2-bis(chloromethyl)propyl phosphate and wherein said emulsifying agent has an acid number from about 30 to about 130 and a phosphorus content from about 2 to 5 percent.

48. The intermediate flame retardant composition of claim 47 wherein said flame retardant compound is bis(2,3-dibromopropyl)-3-bromo-2,2-bis(bromomethyl)-propyl phosphate and wherein said emulsifying agent has an acid number from about 48 to about 120 and a phosphorus content from about 2.2 to about 4.0 percent.

49. The flame retardant finish of claim 48 wherein said tetrakis(hydroxymethyl)phosphonium salt is selected from the group consisting of tetrakis(hydroxymethyl)phosphonium oxalate and tetrakis(hydroxymethyl)phosphonium phosphate acetate.

50. The flame retardant finish of claim 43 which also contains about 0.2 to about 0.8 percent of wetting agent.

* * * * *